United States Patent [19]

La Mura et al.

[11] Patent Number: 4,951,570

[45] Date of Patent: Aug. 28, 1990

[54] ELECTRICALLY ACTIVATED DETONATOR WITH PYROTECHNIC DEVICE RECEIVING TERMINALS AND METHOD OF MAKING

[75] Inventors: Joseph L. La Mura, West Caldwell; Ronald C. Wallenburg, Pennsauken, both of N.J.

[73] Assignee: Joanell Laboratories, Inc., Livingston, N.J.

[21] Appl. No.: 383,650

[22] Filed: Jul. 24, 1989

[51] Int. Cl.[5] ..... F42B 3/10; F42C 11/00; F42C 19/12

[52] U.S. Cl. ..... 102/202.11; 102/202.9; 102/202.14

[58] Field of Search ..... 102/202.5, 202.9, 202.11, 102/202.14, 472

[56] References Cited

U.S. PATENT DOCUMENTS

| | | | |
|---|---|---|---|
| 307,071 | 10/1884 | Russell | 102/472 |
| 317,409 | 5/1885 | Monfort | 102/472 |
| 319,628 | 6/1885 | Russell | 102/472 |
| 319,629 | 6/1885 | Russell | 102/472 |
| 1,354,100 | 9/1920 | Grant et al. | 102/202.11 |
| 1,798,332 | 3/1931 | Littlebury | 102/202.11 |
| 2,331,007 | 10/1943 | Taylor et al. | 102/202.11 |
| 2,429,490 | 10/1947 | Scherrer | 102/202.11 |
| 3,318,243 | 5/1967 | Miller | 102/202.11 |
| 3,779,167 | 12/1973 | Irish et al. | 102/472 |
| 3,937,143 | 2/1976 | Schlueter | 102/202.11 |
| 4,130,060 | 12/1978 | Murray | 102/202.11 |
| 4,285,153 | 8/1981 | Crouch | 102/472 |
| 4,621,578 | 11/1986 | Vallieres et al. | 102/202.9 |

*Primary Examiner*—Stephen C. Bentley
*Assistant Examiner*—J. Woodrow Eldred

[57] ABSTRACT

A first terminal extends from the central region of a circular cylindrical contact body. A thermoplastic tube is heat shrunk over the cylindrical surface of the body with a leader protruding from an end of the body. The assembly is press fitted into the bore of a circular cylindrical metal sleeve. The interference fit between the parts causes the plastic tube to stretch and compress holding the parts in clamped relation. The leader prevents the plastic tube from slipping out of the joint during the sliding assembly action. A second terminal extends from the sleeve which is in ohmic contact with a metal casing of a pyrotechnic device. An electrically activated match has its electrodes welded to and between the terminals.

14 Claims, 2 Drawing Sheets

ELECTRICALLY ACTIVATED DETONATOR WITH PYROTECHNIC DEVICE RECEIVING TERMINALS AND METHOD OF MAKING

This invention relates to electrically activated detonators for pyrotechnic devices.

Electrically activated detonators, sometimes referred to as initiators, for pyrotechnic devices are known. For example, in U.S. Pat. No. 4,130,060 a pyrotechnic device includes an electrically operated detonator head and base. The base is fitted in an opening in a casing containing pyrotechnic material. The head has a pair of leads as illustrated in FIGS. 1 and 2 of the patent. The leads are soldered to different terminals in the base. The problem with that construction is, that unless otherwise prevented, the detonator head may be ejected through the base opening by the forces created by ignition. Therefore, a plastic plug is disclosed for preventing this ejection problem. Further, the leads of the electrically activated head, sometimes referred to as an electronic match, need to be soldered to different elements of the base where one element is within a tubular conductive tube. Soldering a lead to an element within a tube is somewhat awkward.

Other pyrotechnic detonator devices are disclosed in U.S. Pat. Nos. 3,779,167; 2,429,490; 3,318,243; and 317,409. These all suffer from the drawback in that they represent construction relationships which are relatively difficult to manufacture and assemble or represent construction details that are relatively costly to manufacture in mass production.

In an electrically activated detonator including means for receiving an electrically activated pyrotechnic igniter device having a pair of terminals, a construction in accordance with the present invention comprises a metal cylindrical body, a first electrical terminal extending from the body, an electrical insulator tube and a tubular metal cylindrical member. The body is within the bore of the tube and the tube is within the bore of the tubular member, the body, cylindrical member and tube being concentric. A second terminal extends from the tubular member such that the first and second terminals are juxtaposed in spaced facing relation. The terminals are adapted to receive and electrically couple the terminals of the pyrotechnic igniter device thereto and therebetween.

A detonator, constructed and operated in accordance with the present invention may operate an electrically activated pyrotechnic match which includes first and second electrodes respectively electrically conductively secured to and between the first and second terminals.

A method of making an electrically activated detonator construction in accordance with the present invention comprises forming a cylindrical body having a terminal extending longitudinally from the central region of the body. A thermoplastic tube is heat shrunk over the periphery of the cylindrical body. The tube and body are forced in interference fit within the bore of a metal tubular member along the longitudinal axis of the bore. A longitudinally extending terminal is formed from the member juxtaposed with the body terminal. A feature of the method includes welding the electrodes of the electronic pyrotechnic device to and between the terminals.

IN THE DRAWING

Figure 1:
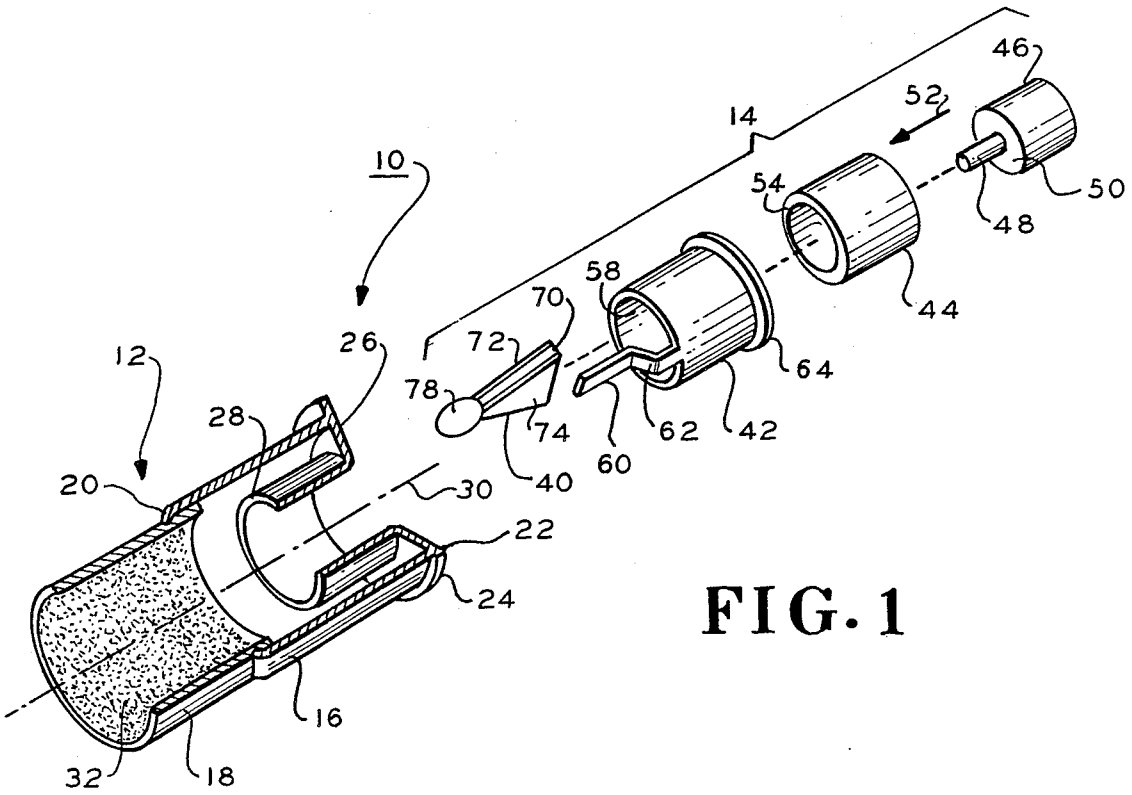
FIG. 1 is an exploded isometric view of a pyrotechnic device and electrically activated detonator in accordance with one embodiment of the present invention with the casing shown partially in section.
Figure 2:
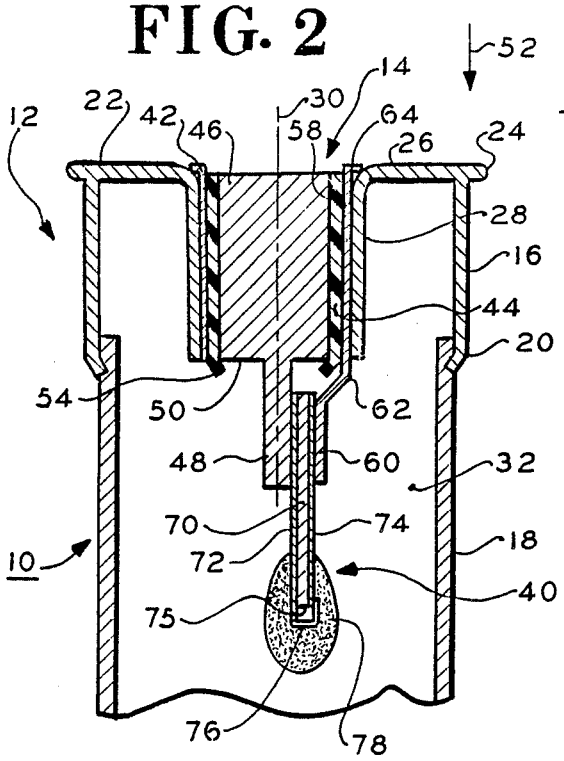
FIG. 2 is a sectional elevation view through the assembled device of FIG. 1.

In FIGS. 1 and 2, pyrotechnic device 10 includes a flash cartridge assembly 12 which may be used, in the alternative, to produce smoke or combinations of flash and smoke. An electrically activated pyrotechnic detonator 14 is assembled to the assembly 12 to form pyrotechnic device 10. The cartridge assembly 12 includes a metal casing 16, which may be brass, and a paperboard tube 18. The tube 18 is crimped to the casing 16 via crimp 20. Casing 16 at end 22 has an outwardly extending flange 24 and an inwardly depending disc-like cap 26. The cap 26 at a central region is bent inwardly within the volume of casing 16 to form a cylindrical sleeve 28 which depends from the cap 26 concentric with axis 30. The casing 16 and tube 18 are filled with pyrotechnic material 32. In the alternative, casing 16 and tube 18 may be an integral insulating material coupled to a metal cap 26.

The detonator 14 includes an electronic match assembly 40, a tubular metal jacket 42, a heat shrinkable thermoplastic insulation tube 44 and a central terminal member 46. Terminal member 46 is preferably a solid metal circular cylinder solid metal, for example brass. Member 46 has an integral circular cylindrical metal terminal 48 extending from end 50. The member 46 and terminal 48 are concentric with axis 30. Thermoplastic tube 44 is heat shrunk over the outer circular longitudinal peripheral surface of member 46. The length of tube 44 in a direction 52 parallel to axis 30 is greater than that of the member 46. Tube 44 extends beyond end 50 of member 46, and due to shrinkage is folded over somewhat at edge 54 adjacent to the terminal 48 at its connection with the end 50 of member 46. The tube 44 edge 54 is bent inwardly somewhat toward terminal 48 as shown in FIG. 2 after the tube 44 is heat shrunk.

The inward folding over of the tube 44 acts as a leader to permit the tube 44 and terminal member 46 assembly to be forced in direction 52 into the bore 58 of jacket 42. The tube 44 is compressed and stretched by this action. The stretching elongates and thins the tube somewhat. The tube 44 may be PVC (polyvinyl chloride). The tube 44 may be 3/16 inch in diameter for shrink fitting over a 0.200 inch diameter terminal member 46. The tube 44 may have a wall thickness of 0.023 inch after shrinking. The resilient compressive load and the relatively high friction of the interface of tube 44 and the mating structure locks the member 46 to jacket 42.

The terminal 60 is formed from the jacket 42 and is integral with the wall of the jacket 42 which is relatively thin walled metal sleeve. Jacket 42 may be brass. The terminal 60 is an elongated sheet metal tab having a bend 62 to position the end of the terminal 60 in spaced relation from the terminal 48. This is best seen in FIG. 2. Jacket 42 also includes an annular flange 64 on an end opposite terminal 60.

Figure 3:
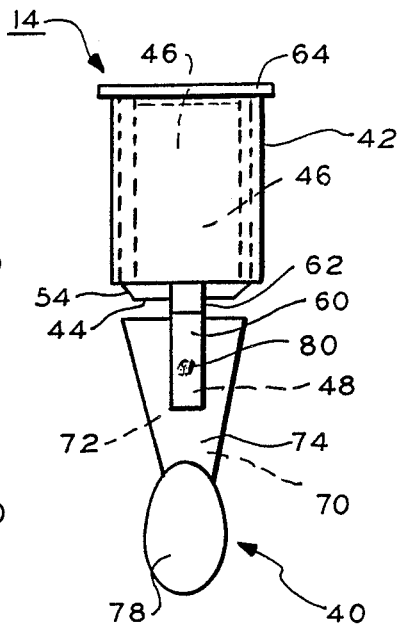
FIG. 3 is a side elevation view of the detonator employed in the embodiment of FIGS. 1 and 2.
Figure 4:
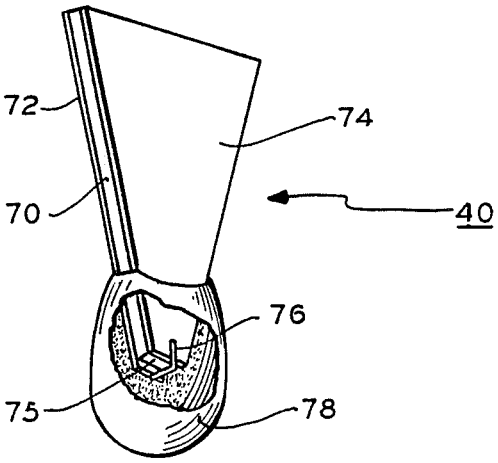
FIG. 4 is an isometric, partially in section, view of an electrically activated pyrotechnic ignitor employed in the embodiments of FIGS. 1, 2 and 3.

In FIGS. 2, 3 and 4, the match assembly 40 comprises a planar sheet insulator 70 having a first planar sheet metal electrode 72 on one surface of the layer 70 and a second planar sheet metal electrode 74 on the opposite side of the insulation layer 70. Layer 70 and electrodes 72 and 74 are trapezoidal of substantially the same dimensions. Electrodes 72 and 74 are connected to a small diameter wire 76. Electrode 72 extends somewhat beyond the end 75. Pyrotechnic material is formed into a match head 78 over the end of the electrodes 72 and 74, insulator 70 and wire 76. The match assembly 40 is available from the Atlas Powder Company. The spacing between terminals 48 and 60, FIG. 2, is sufficient to closely receive the electrodes 74 and 72 therebetween. As shown in FIG. 3, the terminals 60 and 48 are then welded at weld 80 to the respective electrodes 74 and 72.

The outer diameter of the jacket 42 is slightly larger than the inner diameter of sleeve 28 so there is interference compressive fit between the parts when assembled providing good electrical contact therebetween. The detonater 14 is then assembled within the bore of casing 16 sleeve 28 in compressive interference fit. The interference fit between the casing 16 sleeve 28 and jacket 42 locks these elements together by compressive friction loading. The resultant friction forces lock detonater 14 to the assembly 12.

The terminal 48, member 44 and jacket 42 are concentric about axis 30. The terminal 60 however is offset from that axis an amount sufficient to permit the welding of the electrodes of the match assembly 40 thereto. While the terminal 48 is shown on axis 30 it also may be offset from axis 30. Terminal 48 may be in a central region anywhere within the peripheral surface of member 46. All of the elements comprising member 46, tube 44, jacket 42, and sleeve 28 and element 28 are concentric about axis 30 to permit ease of assembling. The welding of the match assembly 40 electrodes to the terminals 60 and 48 provides a convenient, simple, mechanical and electrical attachment without the use of solder joints. In the alternative, of course, the electrodes could be soldered to the terminals, if desired. The casing 16 is available as a conventional shotgun shell. A current is applied to casing 16 and member 46 to ignite match assembly 40 which denotes pyrotechnic material 32.

What is claimed is:

1. In an electrical detonator, including means for receiving an electrical pyrotechnic device having a pair of electrodes the construction comprising:
- a metal cylindrical body;
- a first terminal extending from the body;
- an electrical insulation tube;
- a tubular metal cylindrical member having a longitudinal bore;
- the body being received within the bore of the tube and the tube being received within the bore of the tubular member such that the body, member and tube are concentric; and
- a second terminal extending from the tubular member such that the first and second terminals are juxtaposed in spaced facing relation, said terminals being adapted to receive and electrically couple the electrodes of the pyrotechnic device thereto and therebetween.

2. The construction of claim 1 wherein said body, tube and member are coupled in compressive fit.

3. The construction of claim 1 wherein the first terminal comprises a metal rod extending from the body at a central region of the body.

4. The construction of claim 1 wherein the second terminal comprises an extension of the wall of the tubular member.

5. The construction of claim 1 further including said device, said device comprising first and second planar electrodes secured to each other in spaced electrical isolation by a sheet of insulation and a pyrotechnic media coupled to the electrodes, each electrode being connected to a different terminal and positioned between the terminals.

6. An electrically activated detonator comprising:
- an inner electrically conductive body having first and second ends and a cylindrical longitudinal peripheral surface;
- a first electrical terminal electrically conductively connected to and extending from said body at one end of the body;
- an outer tubular electrically conductive cylindrical member having a longitudinally extending bore;
- means for electrically insulating and securing the inner body to and in the bore of the outer member;
- a second electrical terminal electrically conductively secured to and extending from the outer member juxtaposed with and spaced from the first terminal; and
- an electrically activated pyrotechnic match device including first and second electrodes respectively electrically conductively secured to and between said first and second terminals.

7. The detonator of claim 6 wherein said body comprises a solid circular cylindrical member, said first terminal extending from a central region of the body at said one end.

8. The detonator of claim 6 wherein said second terminal comprises an extension of said outer member extending beyond said member about the same distance as said first terminal.

9. The detonator of claim 6 wherein said first terminal is integral with said body and located within an area of a surface of revolution defined by said peripheral surface.

10. A pyrotechnic device comprising:
- an electrical detonator construction;
- a casing including a metal cap;
- pyrotechnic material within said casing; and
- an electrically activatable match including a pair of electrodes connected to said detonator construction and an ignitable head coupled to said material and said electrodes;
- said detonator construction comprising:
  - a cylindrical tubular metal member electrically connected to and secured to said cap;
  - a cylindrical metal body concentric with and within said member;
  - tubular insulation means between said body and member for securing said body to said member in electrical isolation;
  - a first terminal extending from the metal member and connected to one of said electrodes; and
  - a second terminal extending from the body juxtaposed with said first terminal and secured to the other of said electrodes.

11. The device of claim 10 wherein said member is in compressive fit with said casing and said insulation means is in compressive fit with said body and member to substantially lock said member to said casing and to said body.

12. A method of making an electrical detonator construction comprising:

forming a metal tubular member having a bore;

forming a cylindrical body having a terminal extending longitudinally from a central region of the body;

heat shrinking a thermoplastic tube over the periphery of said cylindrical body;

forcing said tube and body in compressive fit within the bore of said metal tubular member along the longitudinal axis of the bore; and forming a longitudinally extending terminal from said member juxtaposed with said body terminal.

13. The method of claim 12 wherein said forming said body includes forming said body into a circular cylinder and forming the body terminal integral with the body.

14. The method of claim 12 further including an electrical pyrotechnic device having a pair of electrodes, said method including the step of welding the electrodes of said electrical pyrotechnic device to and between the terminals.

* * * * *